US005709617A

United States Patent [19]

Nishimura et al.

[11] Patent Number: 5,709,617

[45] Date of Patent: Jan. 20, 1998

[54] WOOD TYPE GOLF CLUB HEAD

[75] Inventors: Toshinori Nishimura; Masahiko Miyamoto, both of Hiratsuka, Japan

[73] Assignee: The Yokohama Rubber Co., Ltd., Tokyo, Japan

[21] Appl. No.: 686,033

[22] Filed: Jul. 25, 1996

[30] Foreign Application Priority Data

Jul. 27, 1995 [JP] Japan ..... 7-192043
Aug. 10, 1995 [JP] Japan ..... 7-204778

[51] Int. Cl.[6] ..... A63B 53/04

[52] U.S. Cl. ..... 473/330; 473/331

[58] Field of Search ..... 473/329, 330, 473/331

[56] References Cited

U.S. PATENT DOCUMENTS 5,358,249 10/1994 Mendralla ..... 473/331
5,397,127 3/1995 Kawada et al. ..... 473/331
5,484,155 1/1996 Yamawaki et al. ..... 473/331
5,505,450 4/1996 Stuff ..... 473/331
5,595,547 1/1997 Lekavich ..... 473/330

*Primary Examiner*—William M. Pierce
*Attorney, Agent, or Firm*—Finnegan, Henderson, Farabow, Garrett & Dunner

[57] ABSTRACT

When a plurality of grooves extending from the toe side to the heel side are disposed in a plurality of upper to lower rows in a face of a wood type golf club head, these grooves are disposed on the lower portion side of the face and the upper portion side of the face is slicked without disposing the grooves. This arrangement can make a flying distance of a ball greater than by conventional golf club irrespective of rain or shine.

In place of the construction wherein the upper portion side of the face is slicked, it is possible to employ the construction wherein the gaps between grooves disposed on the upper portion side of the face are greater than those between grooves disposed on the lower portion side, or the construction wherein each width of grooves disposed on the upper portion side of the face is smaller than that of grooves disposed on the lower portion side.

21 Claims, 4 Drawing Sheets

WOOD TYPE GOLF CLUB HEAD

BACKGROUND OF THE INVENTION

This invention relates to a wood type golf club head. More particularly, it relates to a wood type golf club head capable of increasing a flying distance more than before irrespective of rain or shine.

Generally, a face 11 of a wood type golf club head is shaped into a slope surface 11*a* which inclines in such a manner that its upper portion is receded progressively rearward to define a loft angle, as shown in FIG. 8. The face 11 formed as the slope surface 11*a* is shaped into a convex shape having a predetermined radius of curvature in a transverse direction, and is shaped into a convex shape having a large predetermined radius of curvature r in a vertical direction of the face 11, too, as shown in FIG. 9.

On such a face 11 are disposed scoring lines 12 each comprising a thin linear groove and dimples 13 each comprising a hemi-spherical groove as shown in FIG. 10, for example. The scoring lines 12 have the same groove width and are disposed equidistantly in the vertical direction. The dimples 13 are disposed between scoring lines 12 aligned in the same line. Such grooves are mainly intended to easily impart a spin to a golf ball when the golf ball is hit.

When the golf ball is hit at the upper portion above the face center in the proximity of the centroid of the head in the wood type golf club head having the construction described above, the ball flies out at a higher flying angle than when the ball is hit at the lower portion, and a spin having large reverse revolution is likely to be imparted. As a result, since the ball flies excessively highly, yardage is not great in spite of its high flying angle, though the ball flies up highly.

To solve such a problem, it may be possible to slick the entire surface of the face 11 of the wood type golf club head as shown in FIG. 11. When such a golf club is produced and the golf ball is hit at the upper portion side above the face center near the head centroid, the quantity of the spin imparted to the ball decreases and consequently, the ball flying out at a high flying angle does not fly up so excessively and can obtain large yardage. When the golf ball is hit at the lower portion side of the face in the rainy weather, however, the ball becomes a drop ball and yardage is short.

SUMMARY OF THE INVENTION

It is therefore an object of the present invention to provide a wood type golf club head which can increase a flying distance much more than before irrespective of rain or shine.

In a wood type golf club head which is equipped with a face having a loft angle on the front side of a head main body, and in which the face is shaped into a convex shape having a predetermined radius of curvature in a vertical direction and a plurality of grooves are disposed in upper to lower rows in the face in such a manner as to extend from the toe side to the heel side, the object of the present invention described above can be accomplished by a wood type golf club head wherein the grooves are aligned on the lower portion side of the face and the upper portion side of the face is slicked.

In a wood type golf club head which is equipped with a face having a loft angle on the front side of a head main body, and in which the face is shaped into a convex shape having a predetermined radius of curvature in a vertical direction and a plurality of grooves are disposed in upper to lower rows on the face in such a manner as to extend from the toe side to the heel side, another wood type golf club head according to the present invention employs the construction wherein the gaps between grooves disposed on the upper portion side of the face are greater than those between the grooves disposed on the lower portion side.

In a wood type golf club head which is equipped with a face having a loft angle on the front side of a head main body, and in which the face is shaped into a convex shape having a predetermined radius of curvature in a vertical direction and a plurality of grooves are disposed in upper to lower rows on the face in such a manner as to extend from the toe side to the heel side, still another wood type golf club head according to the present invention employs the construction wherein the width of the grooves disposed on the upper portion side of the face is smaller than the width of the grooves disposed on the lower portion side.

As described above, the grooves are not at all disposed on the upper portion side of the face but the upper portion side is slicked or smooth in the first embodiment of the present invention. Therefore, when the golf ball is hit at the upper portion side of the face, the ball does not come into frictional contact with the grooves, and the quantity of the spin having the reverse revolution can be drastically reduced from that by the conventional golf club heads. Accordingly although the ball flies out at a high flying angle when hit at the position on the upper porion side, the ball does not fly too highly since the great spin of the reverse revolution which occurs in the conventional golf club is not imparted to the ball which is hit out. Therefore the ball can secure a greater yardage at hitting on the upper portion side of the face, and a greater flying distance can be obtained. In the rainy weather a further greater flying distance can also be obtained.

Since the grooves are disposed on the lower portion side of the face in the same way as those of the conventional golf club heads, the golf ball does not become a drop ball when the ball is hit on the lower portion side of the face in the rainy weather. Accordingly the same flying distance as the conventional golf club heads having grooves on the lower portion side of the face can be obtained. In consequence, the golf club according to this embodiment of the present invention can increase the flying distance more than the conventional golf club heads irrespective of rain or shine.

As further described above, it is also possible to employ the construction wherein each gap between grooves disposed on the upper portion side of the face is wider than that between grooves disposed on the lower side, or the construction wherein each width of grooves disposed on the upper portion side of the face is narrower than that of grooves disposed on the lower portion side, and the flying distance can be increased in the same way as described above.

DESCRIPTION OF THE PREFERRED EMBODIMENTS

Figure 1:
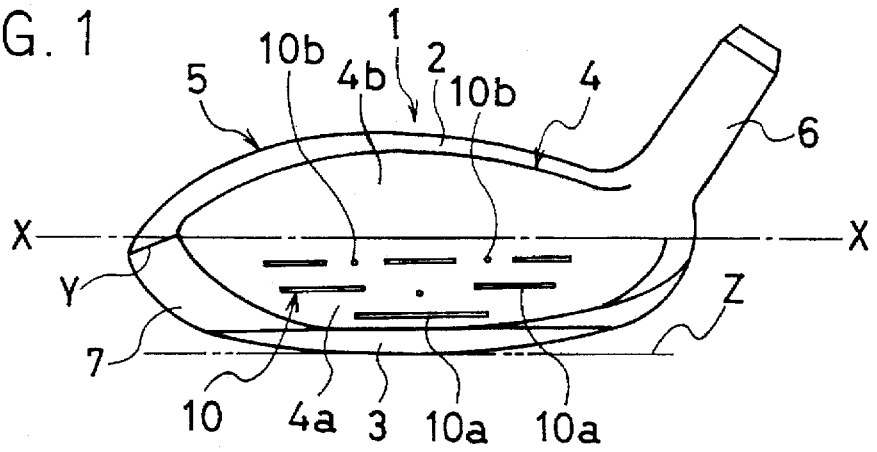
FIG. 1 is a front view showing an example of a wood type golf club head according to the present invention.

As shown in FIG. 1, a wood type golf club head 1 according to the present invention comprises a head main body 5 having a crown portion 2 at its upper part, a sole 3 at its lower part and a face 4 for hitting a ball at its front side, and a hosel 6 for connecting a shaft, which is so formed as to protrude obliquely upward at the heel side of the head main body 5. A sole plate is fixed to the sole 3. A side portion 7 as a slope surface is formed between the crown portion 2 and the sole 3. A ridge line Y which continues from the toe side of the face to the heel side through the back side is formed at the boundary between the side portion 7 and the crown portion 2.

Figure 8:
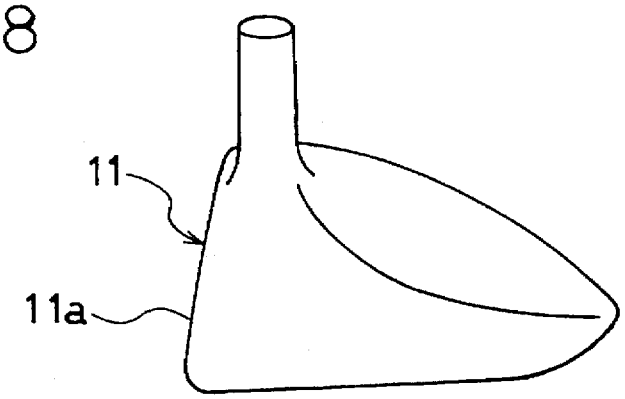
FIG. 8 is a rear view of a wood type golf club head that is ordinarily used.

The face 4 is shaped into the slope surface formed in such a manner that its upper side is positioned progressively rearward in the same way as the face shown in FIG. 8 so as to provide a loft angle. The face 4 formed as the slope surface is shaped into a convex shape having a predetermined radius of curvature in its transverse direction and having a large predetermined radius of curvature r in the vertical direction of the face 4, too, in the same way as in the face shown in FIG. 9. In order to easily apply a spin to a golf ball at the time of hitting, a plurality of grooves 10 are disposed on the lower portion side 4*a* lower than a center line X—X of the face 4 (the line X—X is drawn in parallel with a horizontal plane Z and through the position having the same height as the center of gravity of the head when the golf club head is placed on the horizontal plane Z as shown in FIG. 1). These grooves 10 comprise scoring lines 10*a* having the same linear groove width and dimples 10*b* consisting of hemispherical grooves having the same shape. Three scoring lines 10*a* are disposed in rows which are vertically equidistant and in parallel with one another and extend from the toe side to the heel side. One scoring line is disposed in the lowermost row. Two scoring lines are disposed with a predetermined gap between them in the intermediate row. Three scoring lines are disposed with predetermined gaps between them in the uppermost row. The lengths of the scoring lines 10*a* of the upper rows become progressively shorter. One dimple 10*b* is disposed at the center between the scoring lines 10*a* of the intermediate row. One dimple 10*b* is also disposed at the center between each scoring line 10*a* of the uppermost row. These grooves 10 are not at all disposed on the upper portion side 4*b* higher than the center line X—X of the face 4, and the upper portion side of the face 4 is slicked or smooth.

As described above, no groove is disposed on the upper portion side 4*b* of the face 4 and the face in this portion is slicked in the present invention. According to this structure, since a golf ball does not undergo friction with any grooves, the quantity of the spin of reverse revolution at the time of hitting of the ball at the upper portion side 4*b* can be greatly reduced from that by the prior art golf club. Therefore, when the golf ball is hit at the upper portion side 4*b* above the center line of the face 4 close to the center of gravity of the head, the ball flies out at a high flying angle. However, because a large spin of the reverse revolution, which has been applied to the ball in the prior art golf club, is not applied, the ball does not fly excessively highly. As a result, when the ball is hit at the upper side portion 4*b* of the face 4, it can be driven farther away and a greater flying distance than in the prior art golf club can be obtained. A greater flying distance can also be obtained in the rainy weather.

Grooves similar to those of the prior art are disposed on the lower portion side 4*a* of the face 4. Therefore, when the golf ball is hit at the lower portion side 4*a* of the face 4, a predetermined quantity of the spin of the reverse revolution is imparted to the ball, and the ball does not become a drop ball in the rainy weather unlike the case of the slick face. Therefore, the flying distance equivalent to that of the wood type golf club head of the prior art wherein the grooves are disposed on the lower portion side can be obtained. In other words, the present invention can increase the flying distance irrespective of rain and shine in comparison with the conventional wood type golf clubs.

Figure 2:
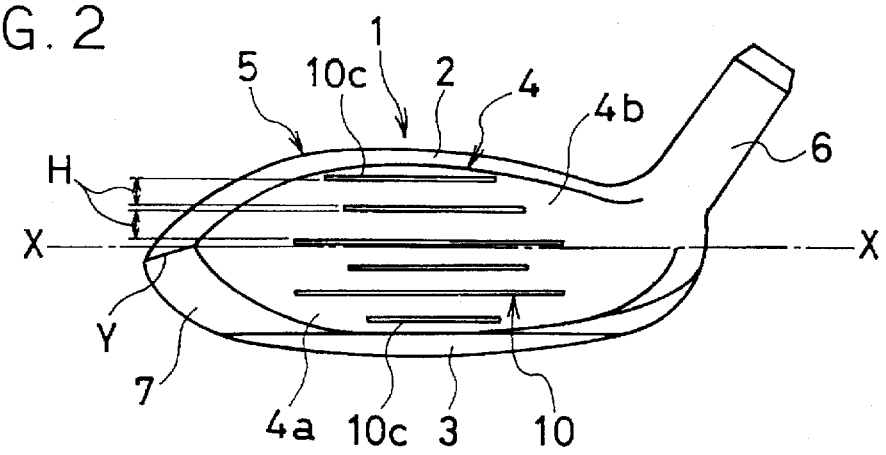
FIG. 2 is a front view showing another example of the wood type golf club head according to the present invention.

FIG. 2 shows another example of the wood type golf club head according to the present invention. Since the grooves 10 are disposed on only the lower portion side 4*a* of the face 4 while the upper portion side 4*b* is slicked in FIG. 1, the feel of imbalance might exist from the design aspect. Therefore, the embodiment shown in FIG. 2 provides the effect described above while eliminating this imbalanced feeling.

In this embodiment, a plurality of grooves 10 are disposed on both upper and lower portion sides 4*b*, 4*a* of the face 4. The drawing shows the scoring lines 10*c* consisting of linear thin grooves as the grooves 10. Needless to say, dimples may be disposed in the same way as described above.

Six rows of the scoring lines 10*c* are disposed in parallel with one another in such a manner as to extend from the toe side to the heel side. Three rows of the scoring lines are disposed on each of the lower and upper portion sides 4*a*, 4*b* of the face 4. The score lines 10*c* each have the same groove width but a different length is disposed in each row of the scoring lines of each of the lower and upper portion sides 4*a*, 4*b* of the face 4. The scoring lines 10*c* on the lower portion side 4*a* are disposed equidistantly in the same way as in the prior art golf club, but the gaps H between the scoring lines 10*c* on the upper portion side 4*b* are greater than those between the scoring lines 10*c* on the lower portion side 4*a*.

Figure 9:
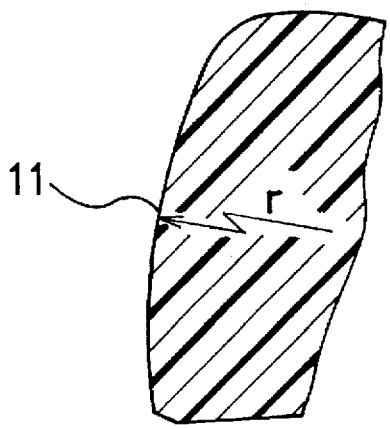
FIG. 9 is a longitudinal sectional explanatory view of a face.

In the faces which are shaped into a convex shape having the radius of curvature in the vertical direction as shown in FIG. 9, when the golf ball is hit at the upper portion side, the ball flies forward while the spin of the reverse revolution is imparted to the ball in such a way that the ball moves to a upper side on the upper portion side greatly revolving. At this time, since the scoring lines 10*c* are disposed with the greater gap than the gap in the conventional golf clubs in this embodiment, the quantity of the spin imparted to the ball when it domes into contact with these scoring lines 10*c* decreases. As a result, even when the ball flies out at a higher flying angle when it is hit at the upper portion side 4*b* of the face 4, the ball does not fly excessively highly as it does in the case of the conventional golf clubs because a large spin of reverse rotation is not imparted to the ball so hit. For this reason, the ball can be driven with a larger yardage when it is hit at the upper portion side 4b of the face 4. Since the grooves are disposed on the lower portion side 4a of the face in the same way as in the conventional golf clubs, the ball does not becomes a drop ball at the time of rain.

Since a plurality of grooves 10 are disposed on both lower and upper portion sides 4a and 4b of the face 4, there is no imbalance feeling from the aspect of design.

The gap H between the scoring lines 10c on an upper side of the upper portion side 4b of the face may be greater than the gap on a lower side of the upper portion side 4b.

Figure 3:
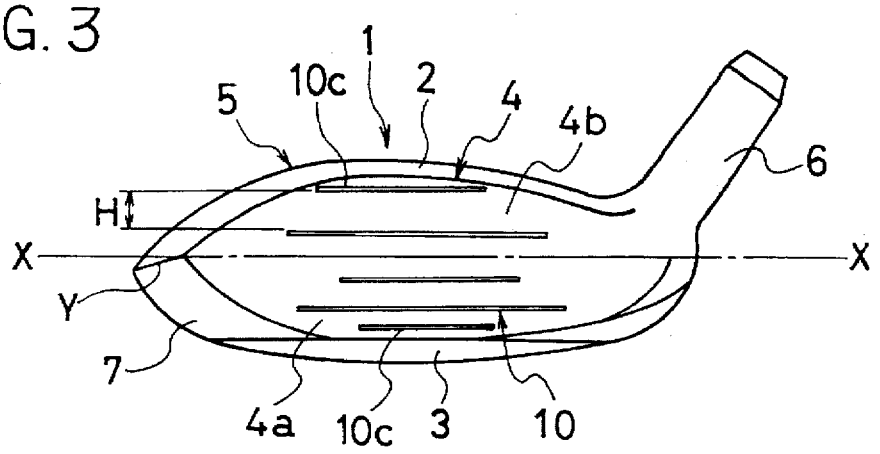
FIG. 3 is a front view showing still another example of the wood type golf club head according to the present invention.

Also, the gap between the scoring lines 10c on an upper side of the lower portion side 4a of the face may be greater than the gap on a lower side of the lower portion side of the face 4. Further, and as shown in FIG. 3, between the scoring lines 10c of both the lower and upper portion sides 4a and 4b may be increased continuously and gradually towards the upper side (the gaps on the upper portion side are greater than those of the prior art). This shows an example where two rows of scoring lines 10c are disposed on the upper portion side 4b. In this way, the drastic change of the flying distance due to the hitting position on the face 4 can be restricted.

Figure 4:
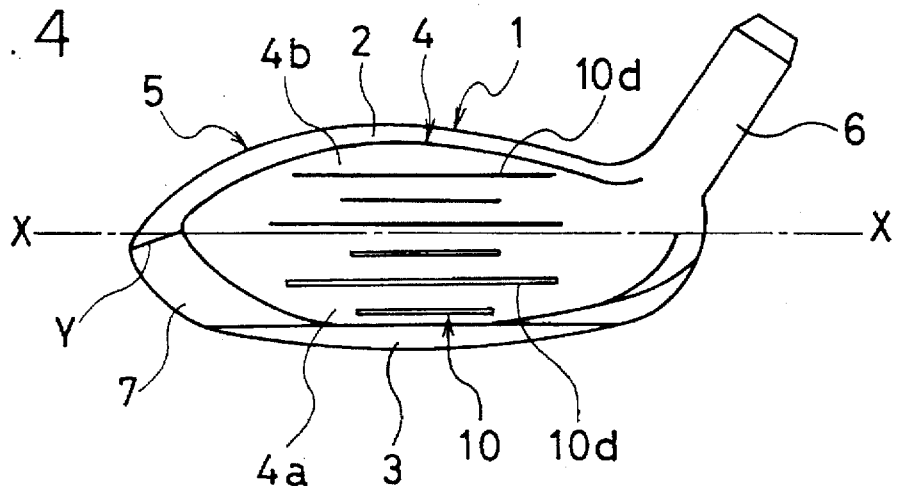
FIG. 4 is a front view showing still another example of the wood type golf club head according to the present invention.

FIG. 4 shows still another example of the wood type golf club head according to the present invention. In the embodiment shown in FIG. 2, gaps H between the scoring lines 10c disposed on the upper portion side 4b are greater than gaps between the score lines 10c disposed on the lower portion side 4a. In place of this arrangement, the present embodiment employs the following arrangement. In other words, six scoring lines 10d are all disposed equidistantly apart, while the groove widths of the three scoring lines 10d on the upper portion side 4b with respect to the center line X—X of the face 4 are smaller than the groove widths of the scoring lines 10d disposed on the lower portion side 4a. This arrangement, too, can obtain same function and effect as described above while avoiding the imbalance feel of design due to the disposition of the scoring lines 10d.

The groove widths of the scoring lines 10d on the upper portion side 4b may be decreased progressively towards the upper side.

Figure 5:
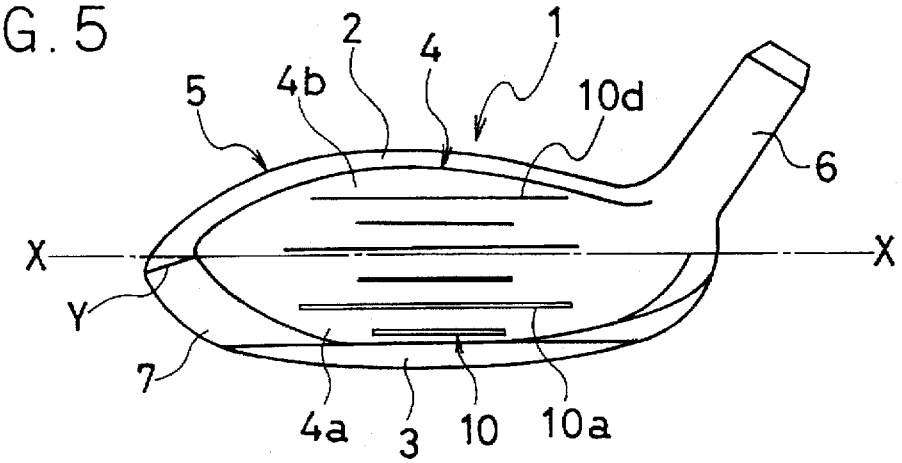
FIG. 5 is a front view showing still another example of the wood type golf club head according to the present invention.

A groove width of an upper side scoring line may be narrower than the one of a lower side scoring line. The groove widths of the scoring lines 10d on both lower and upper portion sides 4a and 4b may be reduced continuously and gradually towards the upper side of the face (with the proviso that each groove width on the upper portion side is smaller than that of the prior art) as shown in FIG. 5. In this way, the drastic change of the flying distance due to the change of the hitting position of the face 4 in a vertical direction can be restricted.

In the embodiments of the present invention described above, the groove widths of the scoring lines 10a and 10c shown in FIGS. 1 to 3 and the groove widths of the scoring lines 10d disposed on the lower portion side 4a of the face in FIG. 4 may be 0.5 to 0.8 mm in the same way as in conventional golf clubs. When dimples are disposed as shown in FIG. 1, the dimple diameter may be 1.0 to 1.2 mm.

Three or four rows of grooves 10 may be disposed on the lower portion side 4a below the center line X—X of the face 4. When the grooves 10 are disposed on the upper portion side 4b as shown in FIGS. 2 to 5, two to four rows of grooves may be disposed. When these grooves are disposed on the entire surface of the face 4, the sum of the rows of the grooves is preferably from five to eight.

Though the upper portion side 4a of the face 4 is slicked in the embodiment shown in FIG. 1, one row of grooves 10 may be disposed thereon. In this case, grooves having the same width as that of the prior art may be disposed, or grooves having a smaller width may be disposed, as well.

In the embodiments of the present invention described above, a ratio of an occupying area of the grooves 10 to the area of the face 4 may be, on the lower portion side 4a below the center line X—X, 11 to 15% of the total area of the lower portion side and on the upper portion side 4b above the center line X—X, 0 to 10% of the total area of the upper portion side.

In the embodiments described above, each scoring line is disposed in such a manner that when the golf club is placed on the horizontal plane Z, each scoring line is in parallel with the horizontal plane Z, but this arrangement is not particularly limitative, and other arrangements may be used so long as the scoring lines are disposed so as to impart the spin to the ball at the time of hitting.

EXAMPLE 1

Figure 10:
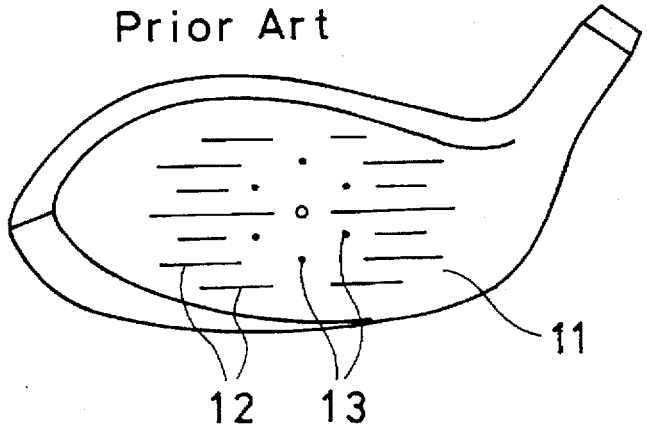
FIG. 10 Prior Art
FIG. 10 is a front view of a wood type golf club head according to the prior art.
Figure 11:
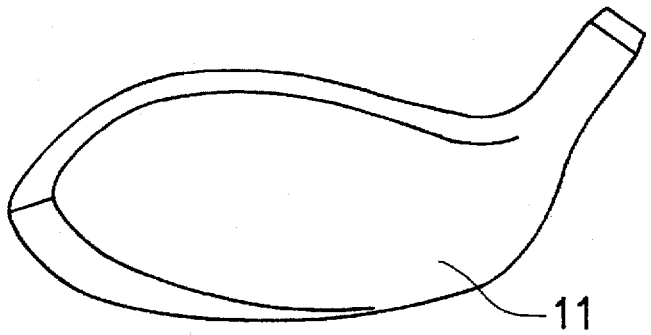
FIG. 11 is a front view of a wood type golf club head wherein the entire surface of the face is slicked.

The wood type golf club head 1 (Example 1) of the present invention wherein the grooves were disposed on only the lower portion side of the face and the upper portion side of the face was slicked, a conventional wood type golf club head 1 (Conventional Example 1) as shown in FIG. 10 wherein grooves were disposed on both upper and lower portion sides of the face and a Comparative wood type golf club head 1 (Comparative Example 1) wherein the entire surface of the face was slicked as shown in FIG. 11 were produced, respectively. The loft angle of the face of each sample club head was 11°.

A club shaft having a length of 44 inches was fitted to each of these sample club heads to produce each sample golf club. When the flying distances of these golf clubs in the rainy and fine weather were evaluated under the following measurement condition, the result tabulated in Table 1 was obtained.

Evaluation test of flying distance:

After each test golf club was fitted to a test hitting robot, golf balls were hit at a head speed of 40 m/sec at two positions 15 mm above and below the center line of the face on the centroid line (a perpendicular line drawn through the head centroid on a front view), respectively. The flying distances (m) in the fine and rainy weather were measured, respectively. Each test is done five times. The numerical value in the table represents the mean distance.

TABLE 1

| | Example 1 | Conventional Example 1 | Comparative Example 1 |
|---|---|---|---|
| flying distance in fine weather (m) | | | |
| face upper side | 180 | 170 | 180 |
| face lower side | 170 | 170 | 170 |
| flying distance in rainy weather (m) | | | |
| face upper side | 215 | 195 | 220 |
| face lower side | 160 | 160 | 140 |

It can be clearly understood from Table 1 that the wood type golf club according to the present invention wherein the grooves were disposed on only the lower portion side of the face and the upper portion side of the face was slicked could increase the flying distance much more than the conventional golf club irrespective of rain or shine.

EXAMPLE 2

The wood type golf club head of Example 2 according to the present invention wherein the gaps between the grooves on the upper portion side of the face were greater than the gaps between the grooves on the lower portion side as shown in FIG. 2, the wood type golf club head of Example 3 according to the present invention wherein the groove widths of the grooves on the upper portion side of the face were smaller than the groove widths of the grooves disposed on the lower portion side as shown in FIG. 4, a conventional wood type golf club head (Conventional Example 2) wherein all the groove widths were the same as that of the lower portion side in the wood type golf club head having the construction shown in FIG. 4 and a comparative wood type golf club (Comparative Example 2) wherein the entire surface of the face was slicked as shown in FIG. 11, were produced, respectively.

The loft angle of the face of each of these test club heads was 11°. In the wood type golf club head of Example 2 according to the present invention, each gap between the grooves was 4.5 mm on the upper portion side of the face and 3.5 mm on the lower portion side, and the groove width was 0.7 mm on both upper and lower portion sides. In the wood type golf club head of Example 3 of the present invention, each groove width was 0.4 mm on the upper portion side of the face and 0.7 mm on the lower portion side, and each groove gap was 3.5 mm on both upper and lower portion sides.

A 44 inch-long club shaft was fitted to each of these test club heads in the same way as described above, and each test golf club was produced. When the flying distances in the fine and rainy weather were evaluated under the same condition as described above, the result tabulated in Table 2 was obtained.

TABLE 2

| | Example 2 | Example 3 | Conventional Example 2 | Comparative Example 2 |
|---|---|---|---|---|
| flying distance in fine weather (m) | | | | |
| face upper side | 180 | 180 | 170 | 180 |
| face lower side | 170 | 170 | 170 | 170 |
| flying distance in rainy weather (m) | | | | |
| face upper side | 215 | 215 | 195 | 220 |
| face lower side | 160 | 160 | 160 | 140 |

It could be understood from Table 2 that the wood type golf club of the present invention wherein the gaps between the grooves disposed on the upper portion side of the face were greater than the gaps between the grooves on the lower portion side and the wood type golf club of the present invention wherein the width of the grooves on the upper portion side of the face was smaller than the width of the grooves on the lower portion side could increase the flying distance irrespective of rain or shine more than the conventional golf clubs.

EXAMPLE 3

The wood type golf club according to the present invention wherein the gaps between the grooves become gradually greater towards the upper side as shown in FIG. 3 and the wood type golf club of the present invention wherein the groove widths become gradually smaller towards the upper side as shown in FIG. 5 were produced, respectively. The loft angle of the face of each of the test club heads was 11°.

The gaps between the grooves in the wood type golf club head of FIG. 3 according to the present invention were 2 mm, 2.5 mm, 3 mm, 3.5 mm and 4 mm respectively from the lower to upper side, and each groove width was 0.7 mm. The groove widths in the wood type golf club head of FIG. 5 according to the present invention were 0.8 mm, 0.7 mm, 0.6 mm, 0.5 mm and 0.4 mm from the lower to upper side, and each groove gap was 3.5 mm.

Figure 6:
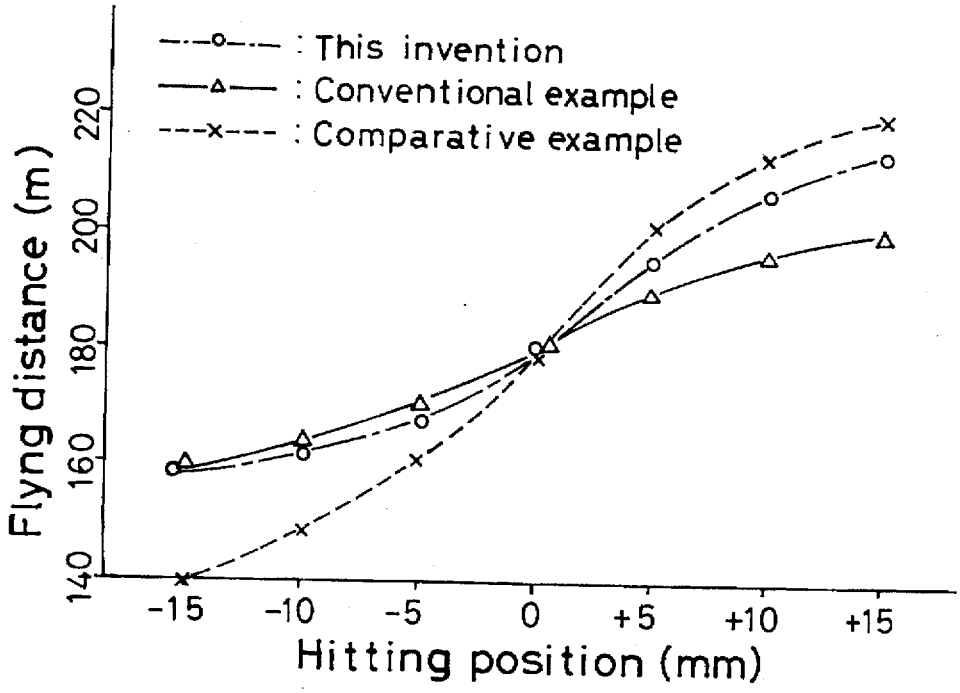
FIG. 6 is a graph showing flying distances in the case of rain by a wood type golf club head according to the present invention wherein the gaps between grooves become gradually broader towards an upper side of the face, a conventional one and a comparative one.
Figure 7:
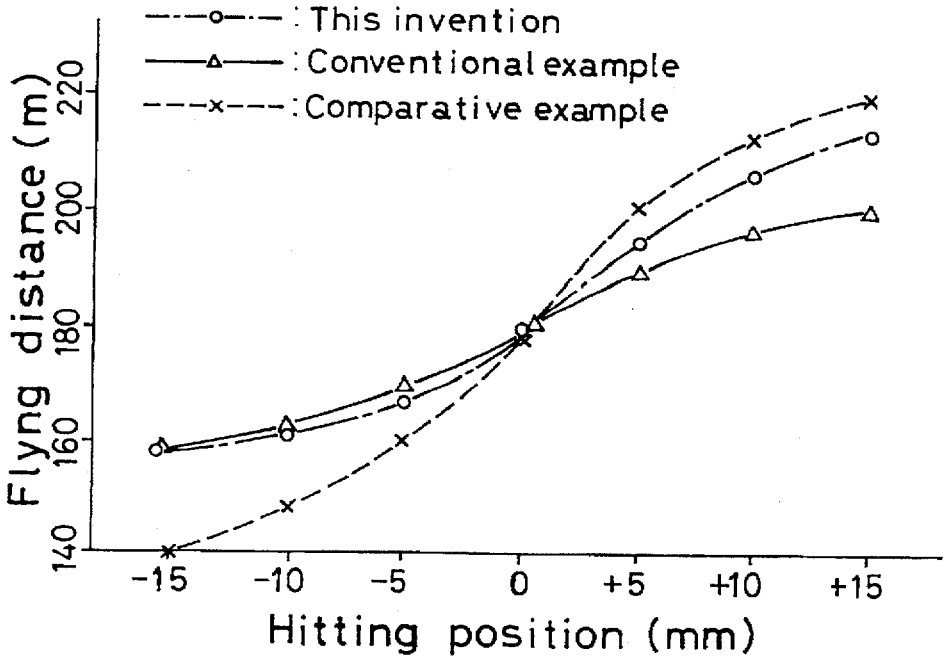
FIG. 7 is a graph showing flying distances in the case of rain by a wood type golf club head according to the present invention wherein the widths of grooves become gradually narrower towards an upper side of the face, a conventional one and a comparative one.

A 44 inch-long club shaft was fitted to each test club head in the same way as described above and each test golf club was produced. The evaluation test of the flying distance in the rainy weather when the hitting position of the face was changed was conducted under the following measurement condition. The results are shown in FIGS. 6 and 7. FIG. 6 shows the result of the wood type golf club head of FIG. 3 and FIG. 7 shows the result of the wood type golf club head of FIG. 5 according to the present invention. Incidentally, FIGS. 6 and 7 also show the results of the evaluation test of the flying distances of the conventional wood type golf club head 2 (Conventional Example 2) and the comparative wood type golf club head 2 (Comparative Example 2) in Example 2 described above. The results of the wood type golf club heads of this invention are represented by a graph connecting circles ○ by one-dot-chain line, the result of the conventional wood type golf club is represented by a graph connecting triangles Δ by solid line, and the result of the comparative wood type gold club connecting x by dotted lines.

Evaluation teat of flying distance:

Each test golf club was fitted to a test hitting robot, and the hitting position was changed from the position 15 mm below the center line of the face to the position 15 mm above the center line at an interval of 5 mm, and the golf balls were hit at a head speed of 40 m/sec. The flying distances (m) in the rainy weather were measured, respectively. Hitting of the balls was made five times at the same position in the rainy weather, and the numerical values in the drawings represent the mean distances.

Incidentally, the hitting position 0 represents the position on the center line of the face, and symbols – and + represent the positions below and above the center line, respectively in FIGS. 6 and 7.

It could be understood from FIGS. 6 and 7 that the wood type golf clubs according to the present invention could increase the flying distance more than the conventional golf clubs and could restrict the drastic change of the flying distance due to the change of the hitting position on the face.

As described above, the wood type golf club according to the present invention employs the construction wherein the grooves are disposed on the lower portion side of the face while the upper portion side is slicked, or the construction wherein each gap between the grooves disposed on the upper portion side of the face is made greater than each gap between the grooves disposed on the lower portion side, or the construction wherein each groove width of the grooves disposed on the upper portion side of the face is made smaller than that of the grooves disposed on the lower portion side. According to these constructions, the ball flies out at a high flying angle when it is hit at the position on the upper portion side from the face center close to the centroid of the head, and since the great spin of the reverse revolution, which has occurred in the conventional golf clubs, is not imparted to the ball so hit out, the ball does not fly too highly. Therefore, the ball can secure a greater yardage than by the conventional golf clubs when it is hit on the upper portion side of the face, and a further greater flying distance can be obtained in the rainy weather. Since the grooves are disposed on the lower portion side of the face in the same way as in the conventional golf clubs, the golf ball does not become a drop ball unlike with the slick face golf club even when the ball is hit on the lower portion side of the face in the rainy weather, and the same flying distance can be obtained as in the prior art. Accordingly, the golf club head according to the present invention can increase the flying distance more than the conventional golf club heads irrespective of rain or shine.

What is claimed is:

1. In a wood type golf club head having a club head body, said body having a toe side, a heel side, a crown on an upper side, a sole on a lower side and a face with a loft angle on a front side thereof, said face having a convex shape with a predetermined radius of curvature in a vertical direction with a plurality of grooves disposed in rows on said face and extending from the toe side to the heel side of said body, the improvement comprising rows of grooves disposed essentially only on a lower side portion of said face while an upper side portion of said face is essentially smooth, said lower side portion lying below and said upper side portion lying above a center line X—X on the face of the club head body that is in a plane coincident with the center of gravity of the club head body and parallel to a horizontal plane Z—Z coincident with the sole of the club head body.

2. The wood type golf club head of claim 1, wherein said grooves include a plurality of straight scoring lines.

3. The wood type golf club head of claim 2, wherein the plurality of said scoring lines are parallel to one another.

4. The wood type golf club head of claim 2, wherein said grooves include dimples.

5. The wood type golf club head of claim 1, wherein said rows of grooves are disposed only on the lower side portion of the face below the center line X—X and the upper side portion of the face is entirely smooth.

6. The wood type golf club head of claim 1, having one row of at least one groove disposed on the essentially smooth upper side portion of said club head face.

7. The wood type golf club head of claim 1, wherein three to four rows of grooves are provided on the lower side portion of the club head face, each row having the same groove width and being space equidistantly from one another.

8. The wood type golf club head of claim 1, wherein the grooves on the lower side portion of the club head face occupy from 11 to 15% of the total area of the lower side portion of the club head face.

9. In a wood type golf club head having a club head body, said body having a toe side, a heel side, a crown on an upper side, a sole on a lower side and a face with a loft angle on a front side thereof, said face having a convex shape with a predetermined radius of curvature in a vertical direction with a plurality of grooves disposed in rows on said face and extending from the toe side to the heel side of said body, the improvement comprising rows of grooves disposed on a lower side portion of said face and rows of grooves disposed on an upper side portion of said face, said lower side portion lying below and said upper side portion lying above a center line X—X on the face of the club head body that is in a plane coincident with the center of gravity of the club head body and parallel to a horizontal plane Z—Z coincident with the sole of the club head body, said rows of grooves being spaced apart a greater distance on said upper side portion than the rows of grooves on said lower side portion.

10. The wood type golf club head of claim 9, wherein the spacing between the rows of grooves on the face becomes gradually greater from the sole toward the crown of the club head body.

11. The wood type golf club head of claim 9, wherein said grooves include a plurality of straight scoring lines each having the same groove width.

12. The wood type golf club head of claim 11, wherein the plurality of said scoring lines are mutually parallel.

13. The wood type golf club head of claim 11, wherein said grooves include dimples.

14. The wood type golf club head of claim 9, wherein three to four rows of grooves are provided on the lower side portion of the club head face that are spaced equidistantly from one another and two to four rows of grooves are provided on the upper side portion of the club head face.

15. The wood type golf club head of claim 9, wherein the grooves on the lower side portion of the club head face occupy from 11 to 15% of the total area of the lower side portion of the club head face and the grooves on the upper side portion occupy 10% or less of the total area of the upper side portion of the club head face.

16. In a wood type golf club head having a club head body, said body having a toe side, a heel side, a crown on an upper side, a sole on a lower side thereof and a face with a loft angle on a front side thereof, said face having a convex shape with a predetermined radius of curvature in a vertical direction with a plurality of grooves disposed in rows on said face and extending from the toe side to the heel side of said body, the improvement comprising said grooves of the rows of grooves disposed on an upper side portion of said face being smaller in width than the width of the grooves of the rows of grooves disposed on a lower side portion of said face.

17. The wood type golf club head of claim 16, wherein the widths of said grooves on the club head face become gradually smaller from the sole toward the crown of the club head body.

18. The wood type golf club head of claim 16, wherein said grooves include a plurality of straight scoring lines disposed equidistantly from one another.

19. The wood type golf club head of claim 18, wherein the plurality of said scoring lines are mutually parallel.

20. The wood type golf club head of claim 18, wherein said grooves include dimples.

21. The wood type golf club head of claim 16, wherein said lower side portion lies below and said upper side portion lies above a center line X—X on the face of the club head body that is in a plane coincident with the center of gravity of the club head body and parallel to a horizontal plane Z—Z coincident with the sole of the club head body.

* * * * *

UNITED STATES PATENT AND TRADEMARK OFFICE

CERTIFICATE OF CORRECTION

PATENT NO. : 5,709,617
DATED : January 20, 1998
INVENTOR(S) : Toshinori Nishimura et al.

It is certified that error appears in the above-indentified patent and that said Letters Patent is hereby corrected as shown below:

Title Page, Item [57], in the Abstract, delete the Abstract in its entirety and substitute therefor:

--A wood type golf club head having a plurality of grooves extending from the toe side to the heel side on the face of the club head body, the grooves being disposed on the lower side portion of the face with the upper side portion of the face being essentially smooth. Also disclosed are club head bodies where rows of grooves on the upper side portion of the club head face are spaced farther apart than on the lower side portion and grooves on the upper side portion that are smaller in width than those on the lower side portion of the club head face. These arrangements make the flying distance of a ball greater than with a conventional

UNITED STATES PATENT AND TRADEMARK OFFICE

CERTIFICATE OF CORRECTION

PATENT NO. : 5,709,617

DATED : January 20, 1998

INVENTOR(S) : Toshinori Nishimura et al.

It is certified that error appears in the above-identified patent and that said Letters Patent is hereby corrected as shown below:

golf club head irrespective of rain or shine.--

Signed and Sealed this

Sixth Day of October, 1998

*Attest:*

*Attesting Officer*

Bruce Lehman

BRUCE LEHMAN

*Commissioner of Patents and Trademarks*